US005584720A

United States Patent [19]

Elswick

[11] Patent Number: 5,584,720

[45] Date of Patent: Dec. 17, 1996

[54] ELECTRICAL CORD PLUG LOCK

[76] Inventor: Lenny B. Elswick, 312 W. Cole Rd., Fremont, Ohio 43420

[21] Appl. No.: 385,827

[22] Filed: Feb. 9, 1995

[51] Int. Cl.[6] ..... H01R 13/62

[52] U.S. Cl. ..... 439/369; 439/368

[58] Field of Search ..... 439/367, 368, 439/369, 370, 345, 350

[56] References Cited

U.S. PATENT DOCUMENTS

| | | | |
|---|---|---|---|
| 3,014,194 | 12/1961 | Berglund | 439/369 |
| 3,999,828 | 12/1976 | Howell | 439/369 |
| 4,221,449 | 9/1980 | Shugart, Jr. | 439/369 |
| 4,643,505 | 2/1987 | House et al. | 439/369 |
| 4,664,463 | 5/1987 | Carmo | 439/369 |
| 4,749,363 | 6/1988 | Luska et al. | 439/367 |
| 5,104,335 | 4/1992 | Conley et al. | 439/369 |
| 5,129,839 | 7/1992 | Van Skiver | 439/367 |
| 5,334,042 | 8/1994 | Chevalier | 439/369 |
| 5,443,397 | 8/1995 | Carl | 439/369 |

*Primary Examiner*—Hien D. Vu

[57] ABSTRACT

An electrical cord plug lock for securing plug of a pair of electrical cords together. The inventive device includes a first cord clamp securable to an extension cord proximal to a plug thereof, and a second cord clamp securable to a power tool cord proximal to a plug of the power tool cord. A joining assembly extends between the cord clamps for securing the plugs together to preclude separation of the plugs during tensioning of the cords.

3 Claims, 3 Drawing Sheets

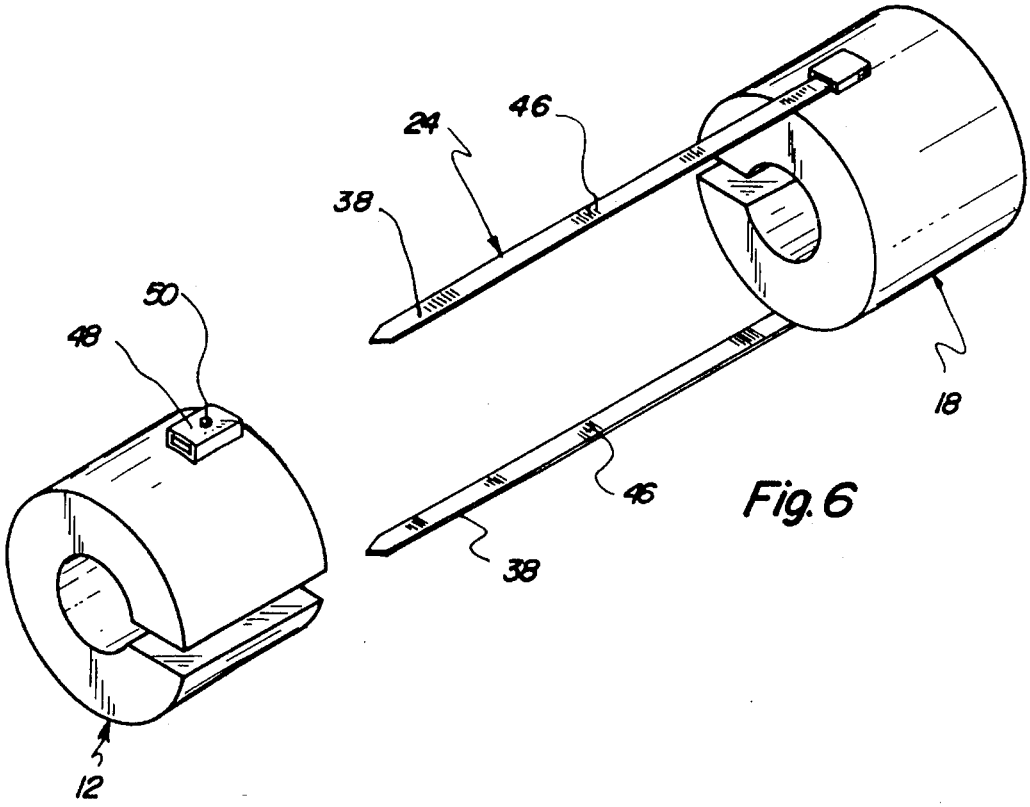
Fig. 6
Fig. 7
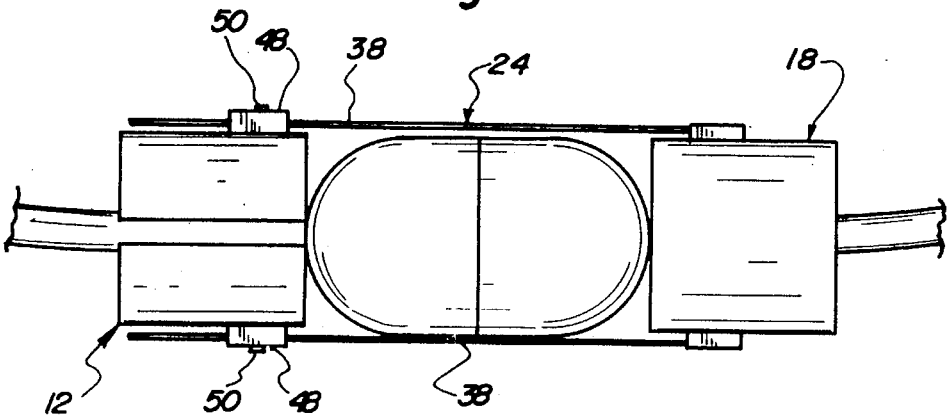

ELECTRICAL CORD PLUG LOCK

BACKGROUND OF THE INVENTION

1. Field of the Invention

The present invention relates to securing devices and more particularly pertains to an electrical cord plug lock for securing the plugs of a pair of electrical cords together.

2. Description of the Prior Art

The use of securing devices is known in the prior art. More specifically, securing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art securing devices include U.S. Pat. Nos. 5,129,839; 5,104,335; 4,749,363; 4,643,505; 4,664,463; and 4,221,449.

While these devices fulfill their respective, particular objectives and requirements, the aforementioned patents do not disclose an electrical cord plug lock for securing the plugs of a pair of electrical cords together which includes a first cord clamp securable to an extension cord proximal to a plug thereof, a second cord clamp securable to a power tool cord proximal to a plug of the power tool cord, and a joining assembly extending between the cord clamps for securing the plugs together to preclude separation of the plugs during tensioning of the cords.

In these respects, the electrical cord plug lock according to the present invention substantially departs from the conventional concepts and designs of the prior art, and in so doing provides an apparatus primarily developed for the purpose of securing the plugs of a pair of electrical cords together.

SUMMARY OF THE INVENTION

In view of the foregoing disadvantages inherent in the known types of securing devices now present in the prior art, the present invention provides a new electrical cord plug lock construction wherein the same can be utilized for securing the plugs of a pair of electrical cords together. As such, the general purpose of the present invention, which will be described subsequently in greater detail, is to provide a new electrical cord plug lock apparatus and method which has many of the advantages of the securing devices mentioned heretofore and many novel features that result in an electrical cord plug lock which is not anticipated, rendered obvious, suggested, or even implied by any of the prior art securing devices, either alone or in any combination thereof.

To attain this, the present invention generally comprises an electrical cord plug lock for securing the plugs of a pair of electrical cords together. The inventive device includes a first cord damp securable to an extension cord proximal to a plug thereof, and a second cord damp securable to a power tool cord proximal to a plug of the power tool cord. A joining assembly extends between the cord clamps for securing the plugs together to preclude separation of the plugs during tensioning of the cords.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new electrical cord plug lock apparatus and method which has many of the advantages of the securing devices mentioned heretofore and many novel features that result in an electrical cord plug lock which is not anticipated, rendered obvious, suggested, or even implied by any of the prior art securing devices, either alone or in any combination thereof.

It is another object of the present invention to provide a new electrical cord plug lock which may be easily and efficiently manufactured and marketed.

It is a further object of the present invention to provide a new electrical cord plug lock which is of a durable and reliable construction.

An even further object of the present invention is to provide a new electrical cord plug lock which is susceptible of a low cost of manufacture with regard to both materials and labor, and which accordingly is then susceptible of low prices of sale to the consuming public, thereby making such electrical cord plug locks economically available to the buying public.

Still yet another object of the present invention is to provide a new electrical cord plug lock which provides in the apparatuses and methods of the prior art some of the advantages thereof, while simultaneously overcoming some of the disadvantages normally associated therewith.

Still another object of the present invention is to provide a new electrical cord plug lock for securing the plugs of a pair of electrical cords together.

Yet another object of the present invention is to provide a new electrical cord plug lock which includes a first cord clamp securable to an extension cord proximal to a plug thereof, a second cord clamp securable to a power tool cord proximal to a plug of the power tool cord, and a joining assembly extending between the cord clamps for securing the plugs together to preclude separation of the plugs during tensioning of the cords.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is an exploded isometric illustration of an alternative form of a joining means of the invention.

FIG. 7 is an elevational view of the alternative form of the invention in use.

DESCRIPTION OF THE PREFERRED EMBODIMENT

Figure 1:
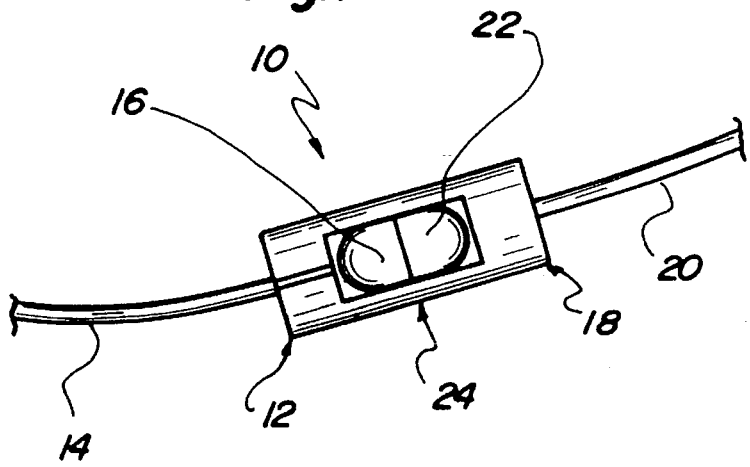
FIG. 1 is an isometric illustration of an electrical cord plug lock according to the present invention in use.

With reference now to the drawings, and in particular to FIGS. 1–7 thereof, a new electrical cord plug lock embodying the principles and concepts of the present invention and generally designated by the reference numeral 10 will be described.

More specifically, it will be noted that the electrical cord plug lock 10 comprises a first cord clamp means 12 for securing to a first electrical cord 14 proximal to a first electrical plug 16 thereof, and a second cord clamp means 18 for securing to a second electrical cord 20 proximal to a second electrical plug 22, as shown in FIG. 1 of the drawings. A joining means 24 extends between the cord clamp means 12 and 18 to secure the cord clamp means relative to one another to preclude separation of the plugs during tensioning of the cords such as commonly occurs during use of a power tool connected to an extension cord.

Figure 2:
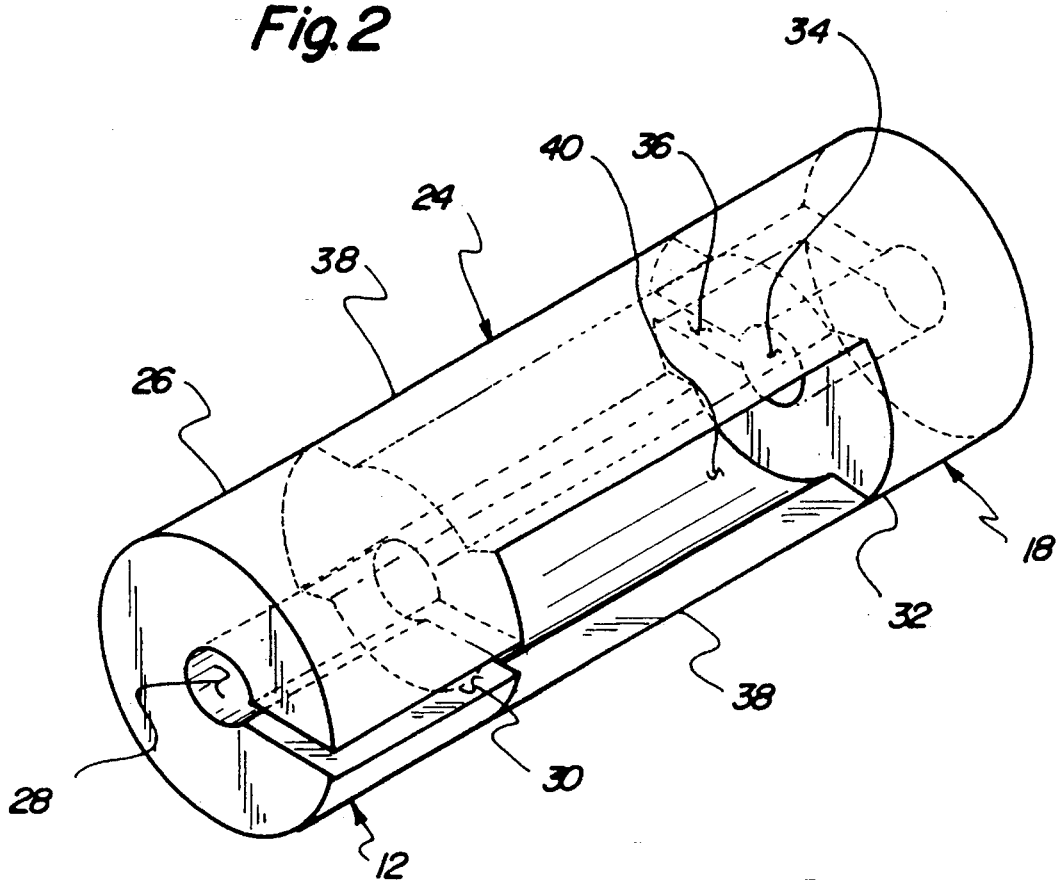
FIG. 2 is an isometric illustration of the present invention, per se.

As best illustrated in FIG. 2, it can be shown that the first cord clamp means 12 preferably comprises a first clamp body 26 formed of a substantially resiliently deformable material. The first cord clamp body 26 is shaped so as to define a first center aperture 28 extending longitudinally through a center thereof, and a first entrance slot 30 directed radially thereinto and into contiguous communication with the first center aperture such that the first electrical cord 14 can be laterally positioned into the first center aperture through the first entrance slot. Similarly, the second cord clamp means 18 preferably comprises a second clamp body 32 formed of a substantially resiliently deformable material. The second cord clamp body 32 is shaped so as to define a second center aperture 34 extending longitudinally through a center thereof, and a second entrance slot 36 directed radially thereinto and into contiguous communication with the second center aperture such that the second electrical cord 20 can be laterally positioned into the second center aperture through the second entrance slot. By this structure, the clamp bodies 26 and 32 can be resiliently deformed or opened to permit insertion of the respective cords 14 and 20 into the center apertures 28 and 34, wherein the resilient nature of the clamp bodies causes the clamp bodies to constrict around or about the electrical cords to frictionally couple therewith.

With continuing reference to FIG. 2, it can be shown that the joining means 24 according to the present invention 10 preferably comprises a pair of coupling links 38 extending between the clamp bodies 26 and 32. The coupling links 38 are secured to diametrically opposed portions of the clamp bodies 26 and 32 and cooperate to support the clamp bodies in a spaced and substantially parallel relationship relative to one another. Further, the coupling links 38 cooperate to define a plug cavity 40 between the coupling links and the clamp bodies 26 and 32 within which the electrical plugs 16 and 22 of the electrical cords 14 and 20 can be positioned during use of the device 10. By this structure, the plugs 16 and 22 are positionable within the plug cavity 40 such that separation of the plugs during tensioning of the associated cords is substantially eliminated.

Figure 3:
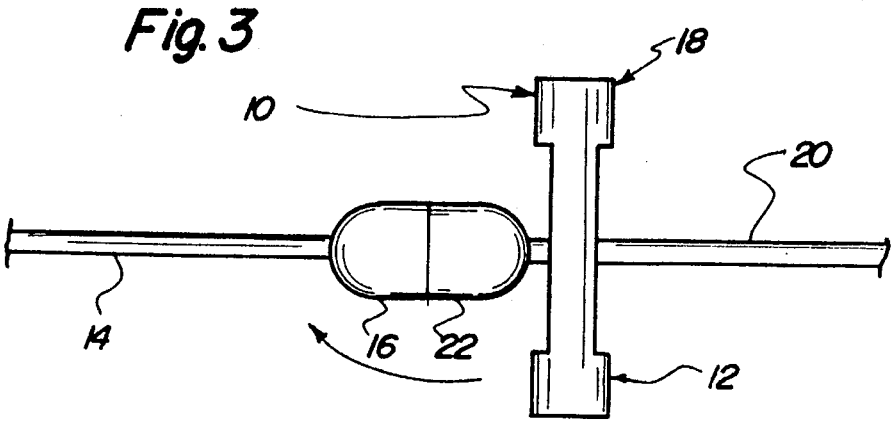
FIG. 3 is an elevational view of the invention during securing thereof to a pair of electrical cords.
Figure 4:
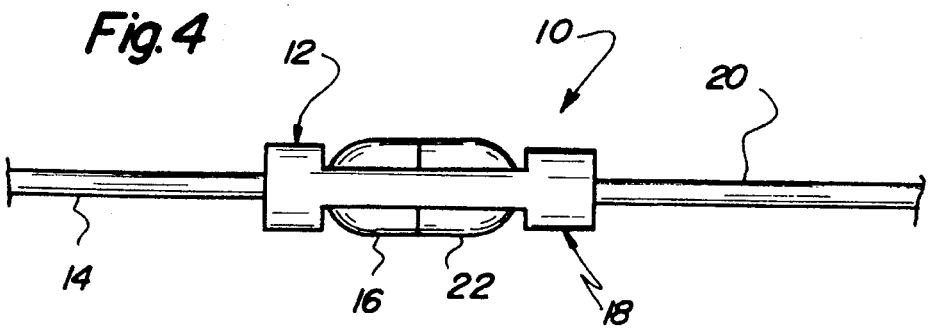
FIG. 4 is an elevational view of the invention after securement thereof to the electrical cords.

With further reference to FIG. 2, it can be shown that the center apertures 28 and 34 of the respective first and second clamp bodies 26 and 32 are preferably colinearly oriented, with the entrance slots 30 and 36 residing within a common plane and projecting in opposed directions from the aligned center apertures. Such configuration of the entrance slots 30 and 36 permits the device 10 to be installed to the electrical cords as shown in FIGS. 3 and 4 of the drawings wherein one of the cords 14 or 20 is positioned through the plug cavity 40. The cords 14 and 20 are then electrically coupled together by a joining of the plugs 16 and 22 thereof. The device 10 can then be positioned centrally over the joined plugs 16 and 22 such that the plugs reside within and orthogonal relative to a longitudinal dimension of the plug cavity 40. The device 10 can then be rotated as shown by the indicating arrows of FIG. 3 into the secured position illustrated in FIG. 4 of the drawings, whereby the cords are simultaneously laterally positioned through the entrance slots 30 and 36 and into the center apertures 28 and 34 to secure the plugs together between the clamp bodies 26 and 32.

Figure 5:
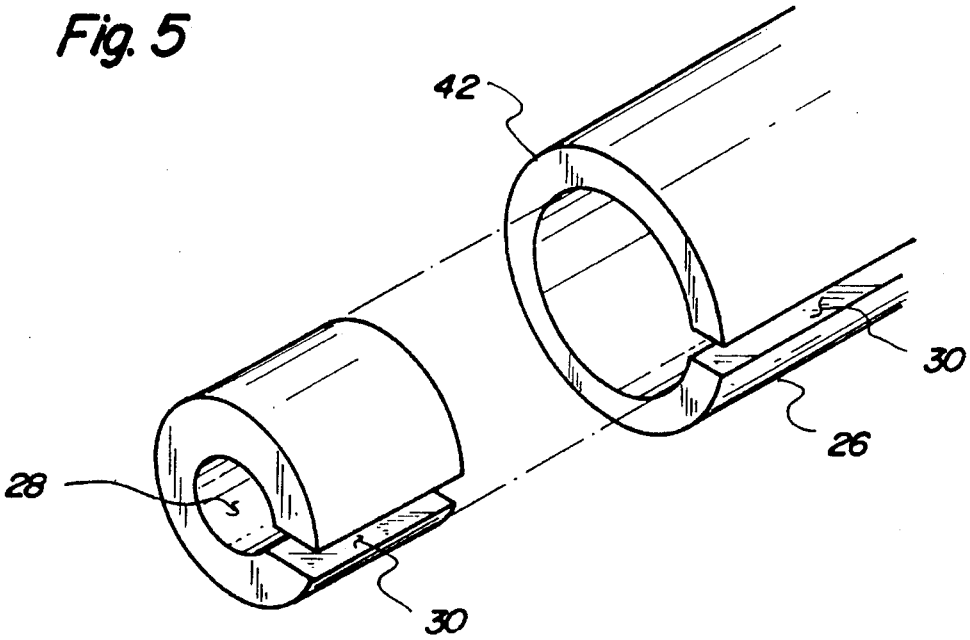
FIG. 5 is an exploded isometric illustration of a construction of the present invention.

As shown in FIG. 5, the device may be constructed of a single length of flexible tubing 42 having diametrically opposed rectangular apertures directed through a center thereof to define the opposed coupling links 38 of the joining means 24 and the exterior portions of the clamp bodies 26 and 32. To reduce an interior diameter of the flexible tubing 42 to completely define the clamp bodies 26 and 32, a section of tubing 44 of smaller diameter relative to the single length of flexible tubing 42 is concentrically positioned within an end of the single length of flexible tubing 42. Both the single length of flexible tubing 42 and the section of tubing 44 are shaped so as to define entrance slots 30 or 36 directed thereinto which extend into contiguous communication with the through-extending center aperture 28 or 34 of the section of tubing 44. The section of tubing 44 can be adhesively or otherwise secured within the single length of flexible tubing 42 by other conventionally known means. Such construction of the invention 10 permits the device to be easily manufactured from available materials. Alternatively, it is contemplated that the entire device 10 be molded from a polymeric material within a suitably shaped mold.

Referring now to FIGS. 6 and 7, it can be shown that the coupling links 38 of the joining means 24 can be fixedly secured to the second cord clamp means 18 and adjustably securable to the first cord clamp means 12. To this end, the coupling links preferably include a plurality of teeth 46 extending therefrom. A pair of link clamps 48 are secured to the first clamp means 12 and each include a through-extending slot through which one of the coupling links 38 can be extended. A spring-loaded locking button 50 of each of the link clamps 48 engages the teeth 46 of the coupling links 38 to lock the respective coupling link relative to the first cord clamp means 12. By this configuration of structure, a distance between the cord clamp means 12 and 18 can be selectively adjusted to accommodate plugs 16 and 22 of various widths.

In use, the electrical cord plug lock according to the present invention can be easily utilized to secure the plugs 16 and 22 of a pair of electrical cords 14 and 20 together to preclude separation of the plugs during tensioning of the cords.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electrical cord plug lock comprising:

a first cord clamp means for securing to a first electrical cord proximal to a first electrical plug thereof;

a second cord clamp means for securing to a second electrical cord proximal to a second electrical plug thereof and;

a joining means extending between the cord clamp means to secure the cord clamp means relative to one another for precluding separation of the plugs during tensioning the cords, wherein the first cord clamp means comprises a first clamp body, the first cord clamp body being shaped so as to define a first center aperture extending longitudinally through a center thereof, and a first entrance slot directed radially into contiguous communication with the first center aperture such that a first electrical cord can be laterally positioned into the first center aperture through the first entrance slot; and further wherein the second cord clamp means comprises a second clamp body, the second cord clamp body being shaped so as to define a second center aperture extending longitudinally through a center thereof, and a second entrance slot directed radially into contiguous communication with the second center aperture such that a second electrical cord can be laterally positioned into the second center aperture through the second entrance slot, wherein the joining means comprises a pair of coupling links extending between the clamp bodies, wherein the coupling links are secured to diametrically opposed portions of the clamp bodies and cooperate to support the clamp bodies in a spaced and substantially parallel relationship relative to one another, with the coupling links cooperating to define a plug cavity between the coupling links and the clamp bodies within which electrical plugs of a pair of electrical cords can be positioned, wherein the center apertures of the respective first and second clamp bodies are oriented along a common longitudinal axis passing through said center apertures, with the first and second entrance slots residing within a common plane including said common axis, each of said first and second entrance slots projecting in diametrically opposed directions perpendicular to said common longitudinal axis of said aligned center apertures in said common plane and with respect to each other such that said first entrance slot forms a first lateral passage intercepting said first center aperture in said first clamp body and said second entrance slot forms a second lateral passage intercepting said second center aperture in said second clamp body, said first and second entrance slots and said corresponding first and second lateral passages being located on opposite side of said first and second clamp bodies, respectively and being oriented substantially 180 degrees with respect to each other, respectively, in said common plane, and wherein the electrical cord plug lock is constructed of a single length of flexible tubing having diametrically opposed rectangular apertures directed through a center thereof to define the coupling links of the joining means and exterior portions of the clamp bodies, whereby when a joined pair of said pair of electrical cords is received within said plug cavity between said first and second clamp bodies in a substantially unaligned relation to the said common longitudinal axis, rotation of said electrical cord plug lock tending to align said joined pair of electrical cords with said common longitudinal axis is effective to cause one of said electrical cords to be received within said first entrance slot, said first lateral passage, and said first center aperture, and the other of said electrical cords to be received within said second entrance slot, said second lateral passage and said second center aperture to thereby lock said joined electrical cords together between said first and second clamp bodies.

2. The electrical cord plug lock of claim 1, wherein the clamp bodies are formed of a substantially resiliently deformable material such that the clamp bodies can be resiliently deformed to permit insertion of the respective cords into the center apertures, wherein the resiliently deformable material of the clamp bodies causes the clamp bodies to constrict about the electrical cords to frictionally couple therewith.

3. The electrical cord plug lock of claim 1 wherein said first and second entrance slots comprising a first section of tubing of smaller diameter relative to the single length of flexible tubing being concentrically positioned within a first end of the single length of flexible tubing; and a second section of tubing of smaller diameter relative to the single length of flexible tubing being concentrically positioned within a second end of the single length of flexible tubing.

* * * * *